United States Patent [19]

Tobita et al.

[11] Patent Number: 4,872,532

[45] Date of Patent: Oct. 10, 1989

[54] SIGNAL TRANSMISSION METHOD AND SYSTEM IN ELEVATOR EQUIPMENT

[75] Inventors: Toshimitsu Tobita; Hiromi Inaba; Masachika Yamazaki, all of Katsuta; Masato Suzuki, Ibaraki; Yuzo Morita, Hitachi; Toshiki Kajiyama, Katsuta; Kiyoshi Nakamura, Katsuta; Kenji Yoneda, Katsuta, all of Japan

[73] Assignee: Hitachi, Ltd., Tokyo, Japan

[21] Appl. No.: 228,229

[22] Filed: Aug. 4, 1988

[30] Foreign Application Priority Data

Aug. 12, 1987 [JP] Japan ..... 62-199780
Jan. 25, 1988 [JP] Japan ..... 63-13795

[51] Int. Cl.[4] ..... B66B 3/00
[52] U.S. Cl. ..... 187/121; 187/130
[58] Field of Search ..... 187/121, 124, 130, 132, 187/133

[56] References Cited

U.S. PATENT DOCUMENTS 3,782,504 1/1974 Billmaier et al. ..... 187/121
4,497,391 2/1985 Mendelsohn et al. ..... 187/121
4,683,989 8/1987 Pillage et al. ..... 187/121
4,700,810 10/1987 Otala ..... 187/130 X
4,709,788 12/1987 Harada ..... 187/124
4,742,893 5/1988 Otala et al. ..... 187/121
4,762,204 8/1988 Blain et al. ..... 187/124 X

*Primary Examiner*—William M. Shoop, Jr.
*Assistant Examiner*—W. E. Duncanson, Jr.
*Attorney, Agent, or Firm*—Antonelli, Terry & Wands

[57] ABSTRACT

In elevator equipment in which an elevator controller is connected by a common transmission line to an elevator cage and a plurality of apparatus installed at elevator stops on respective floors, signals are transmitted from the elevator controller to the elevator cage and the plurality of apparatus of elevator stops on respective floors. Information transmitted between the elevator controller and the cage as well as each apparatus at elevator stop on each floor is sorted into information which is different for each apparatus on each floor and the cage (unique information) and information which is the same for the plurality of apparatus at elevator stops on respective floors and the cage (common information), and the unique information is transmitted during a first period and the common information is transmitted during a second period, thereby reducing time required for transmission of information during one cycle.

20 Claims, 17 Drawing Sheets

SIGNAL TRANSMISSION METHOD AND SYSTEM IN ELEVATOR EQUIPMENT

BACKGROUND OF THE INVENTION

This invention relates to signal transmission method and system in elevator equipment and more particularly to signal transmission method and system suitable for transmission of signals to respective elevator halls and to the cage.

Conventionally, information about respective floors in elevator equipment, for example, information about an elevator hall call button and associated response lamp and an indicator for displaying a cage position is transmitted through a necessary number of transmission lines which are laid to extend from an elevator controller (sometimes simply called a controller) installed in a machine room. In such a system, the number of transmission lines required for transmission of information about hall call buttons and associated response lamps, and indicators in elevator equipment for, for example, only eight floors amounts to 43. That is, the number of transmission lines necessary for hall call buttons and associated response lamps measures [6 (representative of the number of intermediate floors)×4+2 (representative of the number of end floors)×2+1 (common)], the number of transmission lines necessary for indicators measures [2 (representative of the number of direction lamps)+8 (representative of the number of floors) +1 (common)], and the number of transmission lines necessary for signal lamps measures [2+1 (common)], thus totaling to 43. This accounts for the fact that a great number of wiring conductors are needed for transmission of signals to respective floors and as the number of stories of building increases and the function of elevator equipment advances, the interface of the controller faces serious problems in its standardization, installation and maintenance.

To solve these problems, JP-A-61-69677 and JP-A-61-194943 propose a countermeasure in which a main station or a master comprised of a microcomputer is provided in the controller, and a remote station or a slave comprised of a microcomputer is installed on each floor, whereby serial transmission is effected with a view of reducing the number of wiring conductors. This proposal can reduce the number of wiring conductors to a great extent and standardize the interface of the controller.

In the prior art, however, the respective floors are first designated and transmission/reception of information including information common to all of the floors (common information) and information unique to the respective floors (unique information) is carried out in unit of floor, with the result that the common information is transmitted repetitively and timing for turning on the response lamp and the like is inevitably retarded. Since the response lamp in elevator equipment must be turned on within a predetermined interval of time (for example, 0.1 second) following depression of the call button in order for the operator or user not to recognize a retarded response, all of information necessary for the respective floors must be transmitted and received at very high transmission speeds through the complete serial transmission. This will impose great constraint on the system when the number of floors is very large.

Preferably, the elevator equipment is very immune to environmental noise and from this point of view, transmission at a relatively low speed is more desirable than transmission at a very high speed which is sensitive to the noise.

As the function of the elevator equipment advances, in addition to transmission of information about hall call button which is necessary for elevator control, transmission of desired information other than the information for elevator control including traffic information, weather forecast, time information services, visual information and guidance to entertainments being held in building is desired to be performed between each floor and the controller. The prior art does not take such a demand into consideration. Accordingly, when the information transmission has a low transmission speed, there arise problems that the response time is retarded and that the desired information other than that for elevator control can not be transmitted.

Further, the prior art never fails to consider to procedure for accurate exchange of information between the main station or master and each remote station or slave but in the prior art, information received through normal procedure is not checked for its rationality and there is a possiblity that, for example, such an erroneous operation as turn-on of the response lamp takes place even when the call butoon is not depressed. Presumably, the erroneous operation is due to noises generated from nearly power cables, inductive loads or on-off contacts. When interfered with the noises, inconsistencies occur in the information, giving a feeling of uncomfortable elevator riding and causing invalidation of running.

Known references relevant to the present invention will be commented herein. The aforementioned JP-A-61-69677 uses a microprocessor in either of the elevator controller and the apparatus at each elevator stop to permit the two microprocessors to be interconnected together through the serial transmission line but fails to refer to transmission of the unique information and common information.

The aforementioned JP-A-61-194943 describes that a main station installed in the elevator controller is connected to remote stations installed on respective floors or a remote station carried on the cage by a transmission line of bus mode. In this literature, transmission/reception of information is carried out separately between the main station and each remote station. However, like JP-A-61-69677, this reference neither discloses sorting of information into the unique information and common information nor refers to the common information and unique information.

JP-A-55-16829 disclosed by reference herein describes that the elevator controller is connected to the cage by a serial transmission line but in no way describes the connection between the apparatus at elevator stop on each floor and the elevator controller.

JP-A-62-4179 (corresponding to U.S. Pat. No. 4,709,788) disclosed by reference herein describes that a plurality of main stations are provided, remote stations installed on respective floors are connected to the plural main stations through a serial transmission line (bus), and the respective main stations are assigned with the right to control bus with priority, whereby when a main station is not permitted to transmit information, a different main station which is the second to have the right to control bus is then permitted to transmit information, thereby permitting continuity of normal running of the cage. This reference, like JP-A-61-194943, never refers to the common information.

SUMMARY OF THE INVENTION

An object of this invention is to provide signal transmission method and system in elevator equipment which can insure a predetermined response time even when the information transmitter has a low information transmission speed.

Another object of this invention is to provide signal transmission method and system which can insure a predetermined response time even when the information transmitter has a low transmission speed and which can transmit desired information other than that for elevator control.

Still another object of this invention is to provide signal transmission method and system which can detect inconsitencies present in information to be transmitted and can recognize information without inconsistencies as normal information so as to perform a predetermined processing.

According to the invention, information to be transmitted between the elevator controller and each floor station is sorted into information which is different for respective floor stations and a cage (unique information) and information which is the same for the respective floor stations and the cage (common information), and the unique information is transmitted to the respective floor stations and the cage during a first period and the common information is transmitted to the respective floor stations and the cage during a second period, thereby reducing time required for one cycle of transmission.

More specifically, the signal to be transmitted and received between the elevator controller and each floor station is sorted into such a signal as representative of information about indicator which is the same for the respective floor stations and the cage and such a signal as representative of information about hall call button and associated response lamp which is different for the respective floor stations and the cage. An information transmitter (transmission host) on the side of the controller sequentially transmits the information which is different for the respective floor stations to the respective floor stations during the first period and subsequently transmits the information which is the same for the respective floor stations to all floor stations during the second period. This differs from the case where information necessary for the respective floors is all transmitted sequentially to the respective floors and therefore can prevent the same information from being transmitted reiteratively on the transmission like before completion of one cycle of transmission, thus reducing time required for one cycle of transmission and consequently insuring a predetermined response speed even when the transmission speed is low.

Since the information which is the same for the respective floor stations is transmitted to the respective floor stations at a time, the same information can always be displayed on display units of the respective floor stations and error can be minimized.

Further, in addition to the first period during which the information being different for the respective floor stations is transmitted and the second period during which the information being the same for the respective floor stations is transmitted, a third period may be provided during which transmission/reception of a desired signal is effected between the controller and a desired floor station or the cage, so as to ensure transmission of desired information other than that for elevator control. The first to third periods can be sequenced in a desired manner.

Further, means for collating the elevator control information received by the main station and each remote station with a control pattern unique to the elevator equipment is provided in both of the main station and each remote station or in one of them.

Thus, in accordance with the invention, in an information transmission system in elevator equipment comprising a first information transmitter (main station) installed as a master in an elevator controller provided in a machine room of a building, second information transmitters (remote stations) respectively installed as slaves on respective floors of the building and carried on a cage, and a transmission line for interconnecting the first and second information transmitters whereby the first information transmitter sequentially designates the second information transmitters to effect transmission/reception of information, there are provided in at least one of the first and second information transmitters, means for generating predictive information from previous information, and means for comparing the predictive information with information received through the transmission line to check the received information for its rationality.

When the second information transmission includes means for detecting that an up-direction elevator call button or a down-direction elevator call button installed on respective floors is depressed and means for turning on response lamps associated with the up-direction and down-direction call buttons, the predictive information is such information that indicates that when information from the first information transmitter is for instructing the response lamp to be turned on, the associated call button has been depressed.

When the second information transmitter includes means for turning on a direction lamp indicative of running direction of the elevator cage, the predictive information is such information that indicates that when information from the first information transmitter is for instructing the direction lamp to be turned on, the up-direction and down-direction lamps are not to be turned on simultaneously.

Further, when the second information transmitter includes means for displaying the elevator cage position, the predictive information is such information that indicates that when information from the first information transmitter is for instructing the elevator cage position display to be changed, the cage position is to be changed by $\pm 1$ floor (one floor up or down) relative to the previous position.

The master and each slave collate, each time they receive information, the received information with a predetermined pattern and only when coincidence occurs, they operate to recognize the received information as normal information. In this manner, reliability of information can be improved.

DESCRIPTION OF THE PREFERRED EMBODIMENTS

Figure 1:
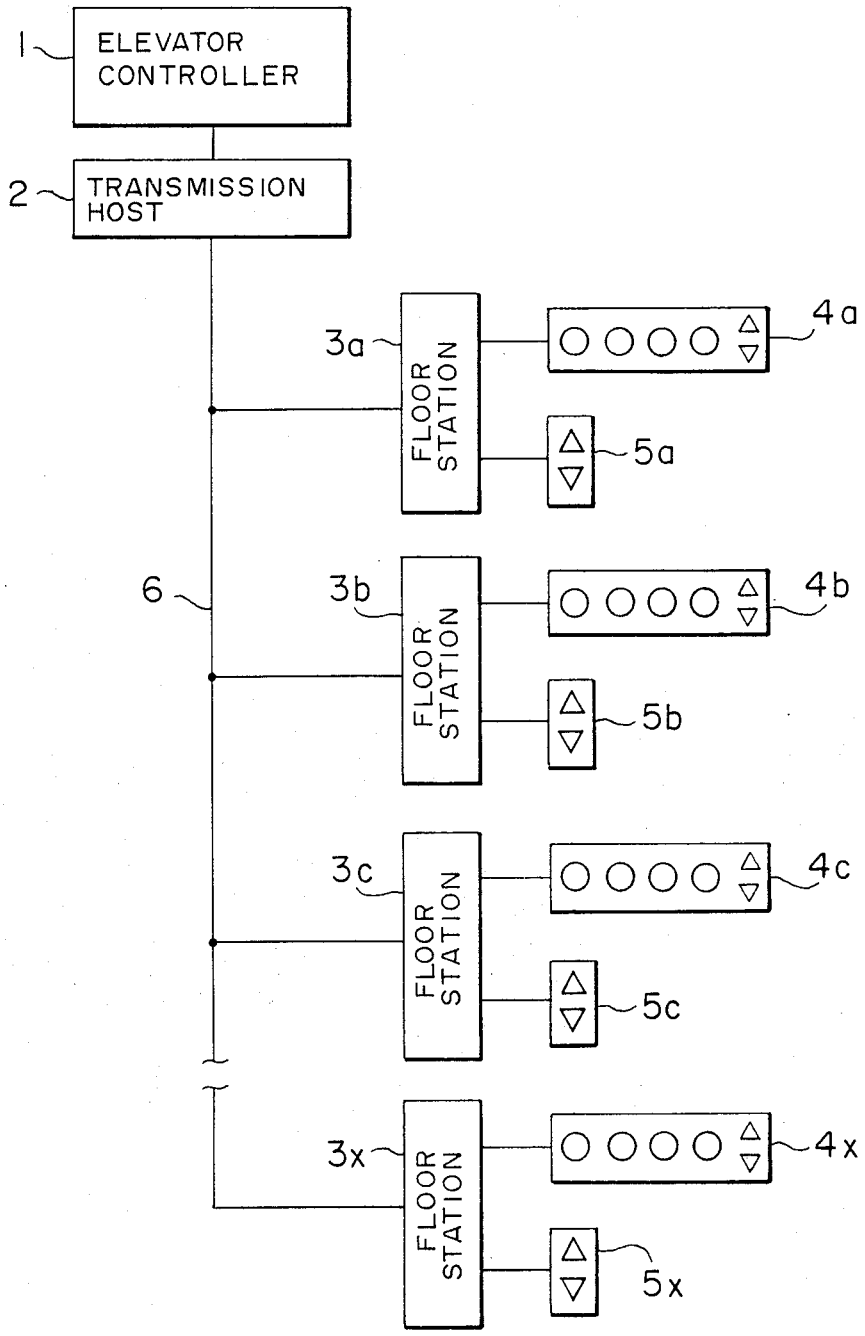
FIG. 1 is a schematic block diagram showing the interconnection of bus mode between the controller and apparatus at elevator stops according to an embodiment of the invention.

Referring now to FIG. 1, there is illustrated an embodiment of a signal transmission system of bus mode which is installed between a host on the side of an elevator controller and individual slaves at elevator stops. The elevator controller, designated by reference numeral 1, is connected to a transmission host (main station) 2 and transmission/reception of elevator floor information is effected between the elevator controller 1 and the transmission host 2. On the basis of receiving information, the elevator controller 1 discriminates running of a cage to determine running direction, stop floor and running position and delivers this information to the transmission host 2. More specifically, the transmission host 2 is connected by a bus 6 to floor stations 3*a*, 3*b*, 3*c*, ---- 3*x* installed on respective floors. The transmission host sequentially polls the floor stations 3*a*, 3*b*, 3*c*, ---- 3*x* on respective floors to perform transmission/reception of information about call button and response lamp which is unique to respective floors. The floor stations 3*a*, 3*b*, 3*c*, ---- 3*x* are respectively connected to call buttons and associated response lamps 5*a*, 5*b*, 5*c*, ---- 5*x*, and each floor station detects whether its call button is depressed and when polled, sends a detection result to the transmission host 2 and receives information from the transmission host to turn on its response lamp. Subsequently, the transmission host 2 sends to the floor stations 3*a*, 3*b*, 3*c*, ---- 3*x* on respective floors common information about indicator which is the same for all floors. The floor stations 3*a*, 3*b*, 3*c*, --- 3*x* on respective floors receive the common information and display results on their indicators 4*a*, 4*b*, 4*c*, ---- 4*x*.

Figure 2:
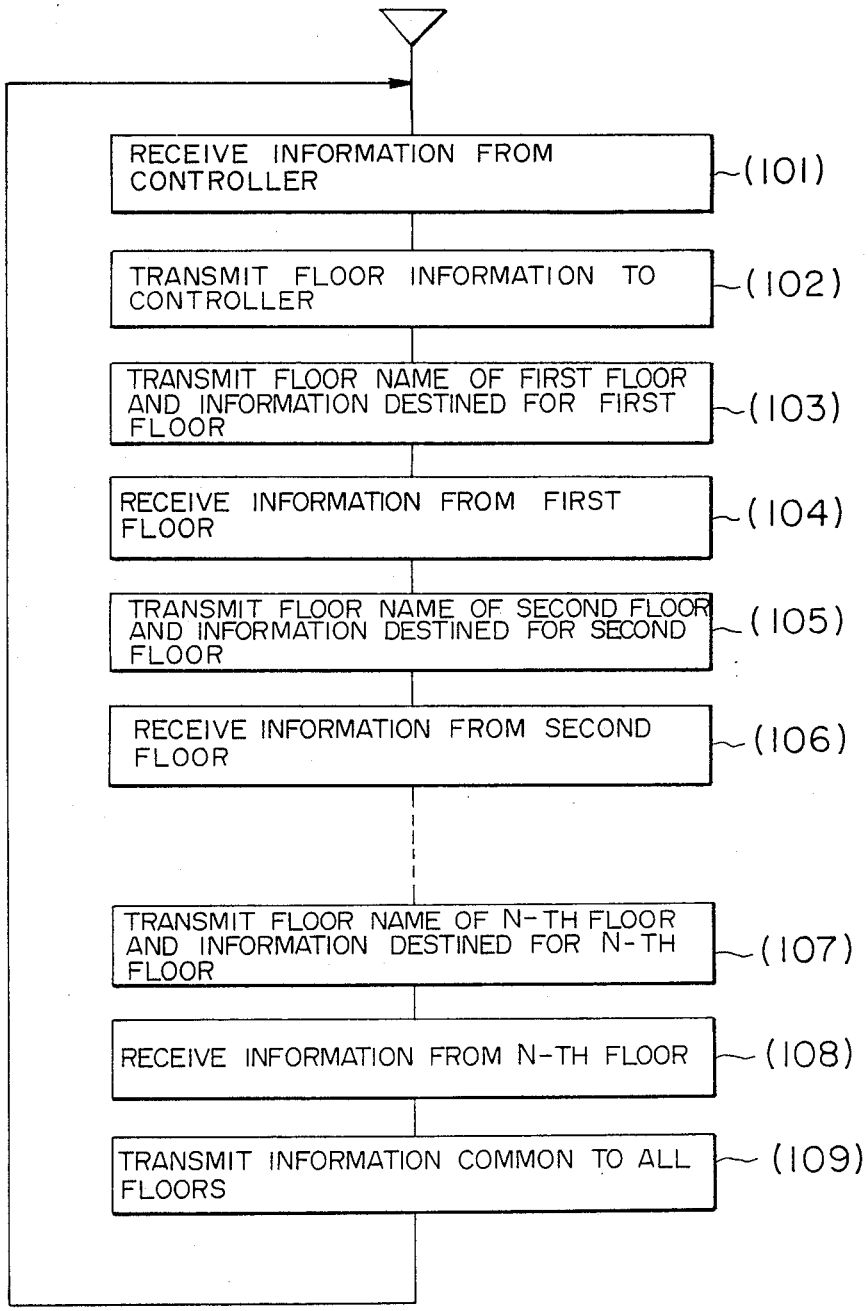
FIG. 2 is a flow chart showing the operation of a transmission host in the FIG. 1 embodiment.

FIG. 2 is a flow chart showing the operation of the transmission host. The transmission host 2 first receives outputinformation about indicator and response light which is directed from the elevator controller 1 to respective floors (step 101) and subsequently sends to the elevator controller 1 input information about call button which is sent from respective floors (step 102). Thereafter, the transmission host 2 transmits information (address code) indicative of a floor name of the first floor and information destined for the first floor (step 103). Each of the floor stations 3*a*, 3*b*, 3*c*, ---- 3*x* collates the floor name transmitted on the bus 6 with a floor name of its own and if non-coincidence occurs, disregards the transmitted information. If coincidence occurs, a floor station in question receives the information and then transmits to the transmission host 2 floor information such as own call button information, which is received by the transmission host 2 (step 104). Such a procedure of transmission/reception is carried out to cover the second floor (steps 105 and 106) ---- the n-th floor (steps 107 and 108). Additionally, the information common to all floors is transmitted (step 109). In this manner, one cycle of procedure ends and the operation returns to the step 101. In this embodiment the individual floor stations are connected each other in parallel to the bus 6 and in the event that one floor station becomes faulty, having a failure to transmit, the remaining floor stations are immune from such a trouble and can continue transmission.

Figure 3:
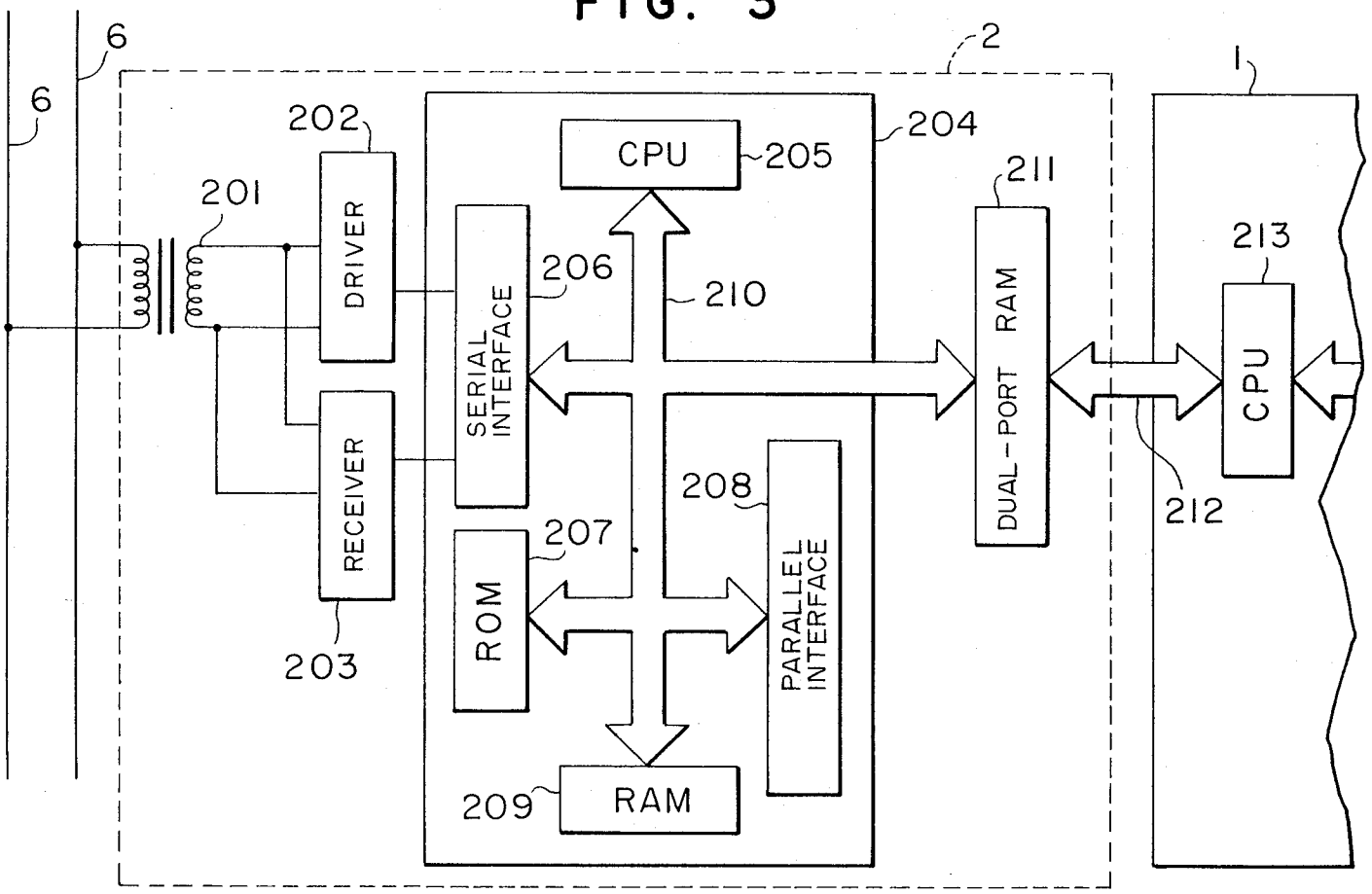
FIG. 3 is a block diagram illustrating the hardware construction of the transmission host in the FIG. 1 embodiment.

FIG. 3 illustrates the hardware construction of the transmission host 2. In this embodiment, a dual-port RAM 211 is used which is readable and writable at two ports. The dual-port RAM 211 is coupled to a bus 212 of a CPU 213 included in the elevator controller 1 and to à bus 210 of a CPU 205 included in the transmission host 2 and cooperates for read and write with the CPU 213 in elevator controller 1 and the CPU 205 in transmission host 2. The CPU 213 in elevator controller 1 first writes the information unique to each floor and the information about indicator which is common to all floors into the dual-port RA 211 and then reads from the dual-port RAM 211 information such as call button information indicative of calling which is sent from the respective floors. The CPU 205 in transmission host 2 reads from the dula-port RAM 211 the information unique to each floor and the information common to all of the floors under the direction of a program written in a ROM 207 and sends the unique information, now assigned with floor names, and the common information to a serial interface 206. The CPU 205 in the transmission host also receives from the serial interface 206 the information such as call button information which is sent from each floor and sends it to the dula-port RAM 211. The serial interface 206 causes a driver 202 to send the unique information onto the transmission line 6 through a pulse transformer 201 and then receives information from the respective floors through the transmission line 6, the pulse transformer 201 and a receiver 203. Denoted by 204 is a one-chip microcomputer including the CPU 205 of transmission host 2, serial interface 206 and ROM 207 as well as RAM 209 and parallel interface 208 which are used by the CPU 205 as a work area for control.

Exemplarily, in the present embodiment, the dual-port RAM 211 is included in the transmission host 2 but it may be provided in the controller 1. The use of the dula-port RAM can advantageously ensure asynchronous read and write but obviously, the provision of the dual-port RAM is not always necessary to construct the present invention. In this case, the CPU 213 in controller 1 may be coupled to the transmission host 2 by way of the parallel interface 208.

Figure 4:
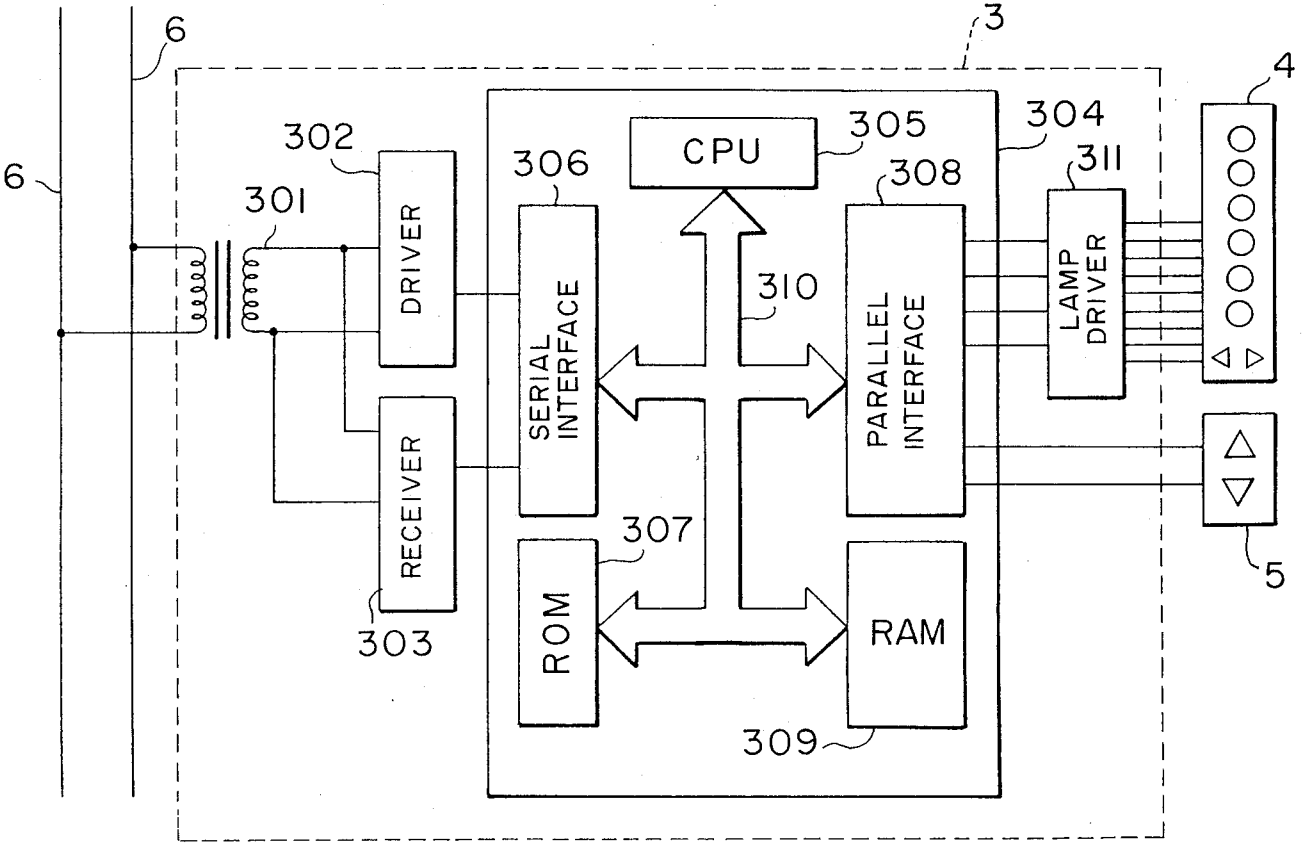
FIG. 4 is a block diagram illustrating the hardware construc,tion of each floor station in the FIG. 1 embodiment.

FIG. 4 illustrates the hardware construction of each of the floor stations *3a, 3b, 3c,* ---- *3x* which are structurally identical to each other and represented by reference numeral 3. A CPU 305 of the floor station 3 reads data for its own floor from a serial interface 306 and temporarily stores the data in a RAM 309 under the direction of a program written in a ROM 307. On the basis of the program stored in the ROM 307, the CPU 305 also sends the data stored in the RAM 309 to a parallel interface 308 which in turn drives a lamp driver 311 to turn on the indicator 4 (representative of each of the indicators *4a, 4b, 4c,* ---- *4x* as in the case of the floor station 3). An input signal from the push button 5 (similarly representative of each of the push buttons *5a, 5b, 5c,* ---- *5x*) is supplied to the parallel interface 308, temporarily stored in the RAM 309 under the control of the CPU 305 of the floor station and sent, as call button information, to a serial interface 306. Denoted by 310 is a bus of the CPU of the floor station, 304 a one-chip microcomputer for performing the above function, 301 a pulse transformer, 302 a driver and 303 a receiver.

Figure 5:
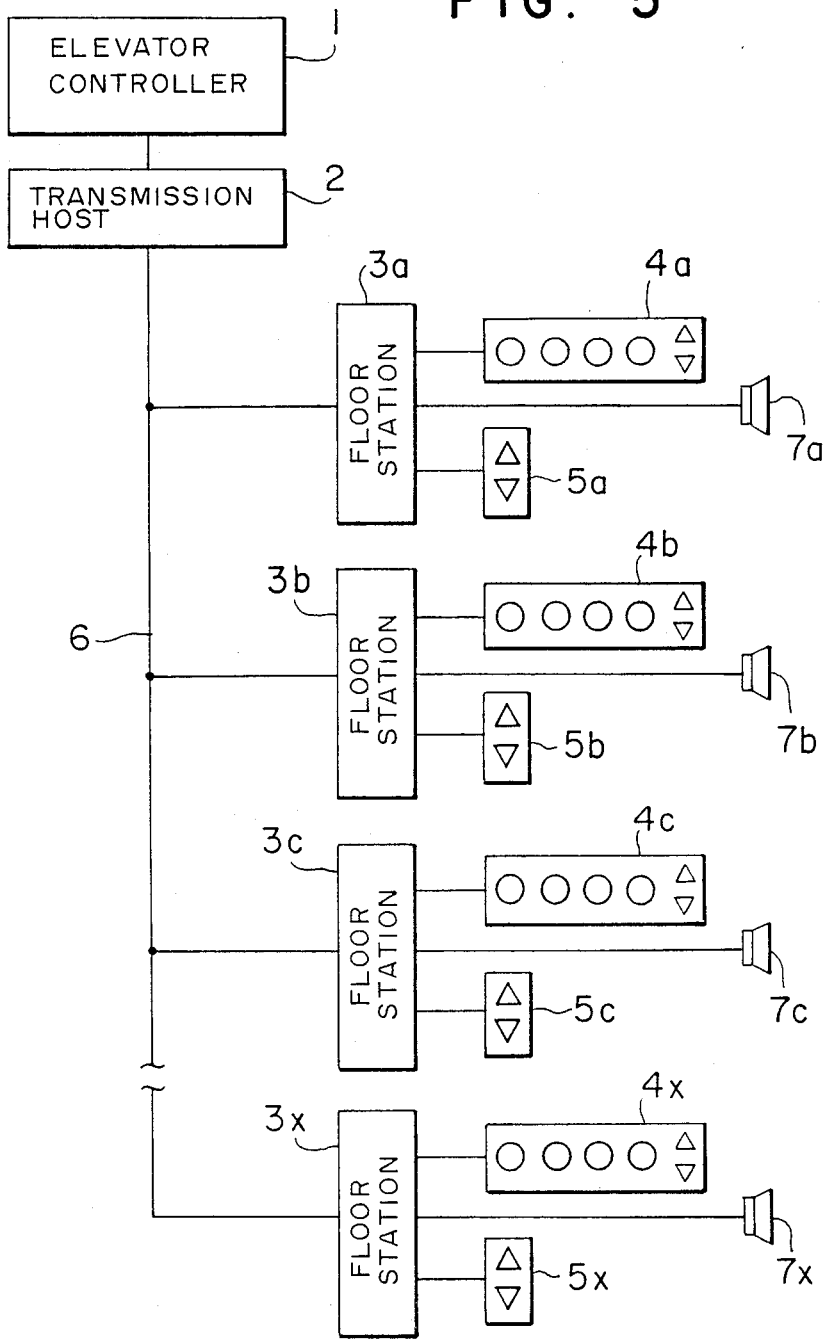
FIG. 5 is a schematic block diagram showing the interconnection of bus mode between the controller and apparatus at elevator stops according to another embodiment of the invention.

FIG. 5 illustrates another embodiment of the signal transmission system which adds to the FIG. 1 embodiment loudspeakers *7a, 7b, 7c,* ---- *7x* installed on respective floors. Each of the loudspeakers *7a, 7b, 7c* ---- *7x* is used for information services by providing sound information about running of the cage, for example, about open/close of the door as well as other information than that necessary for control of the elevator, i.e., guidance to entertainments being held in the building.

Figure 6:
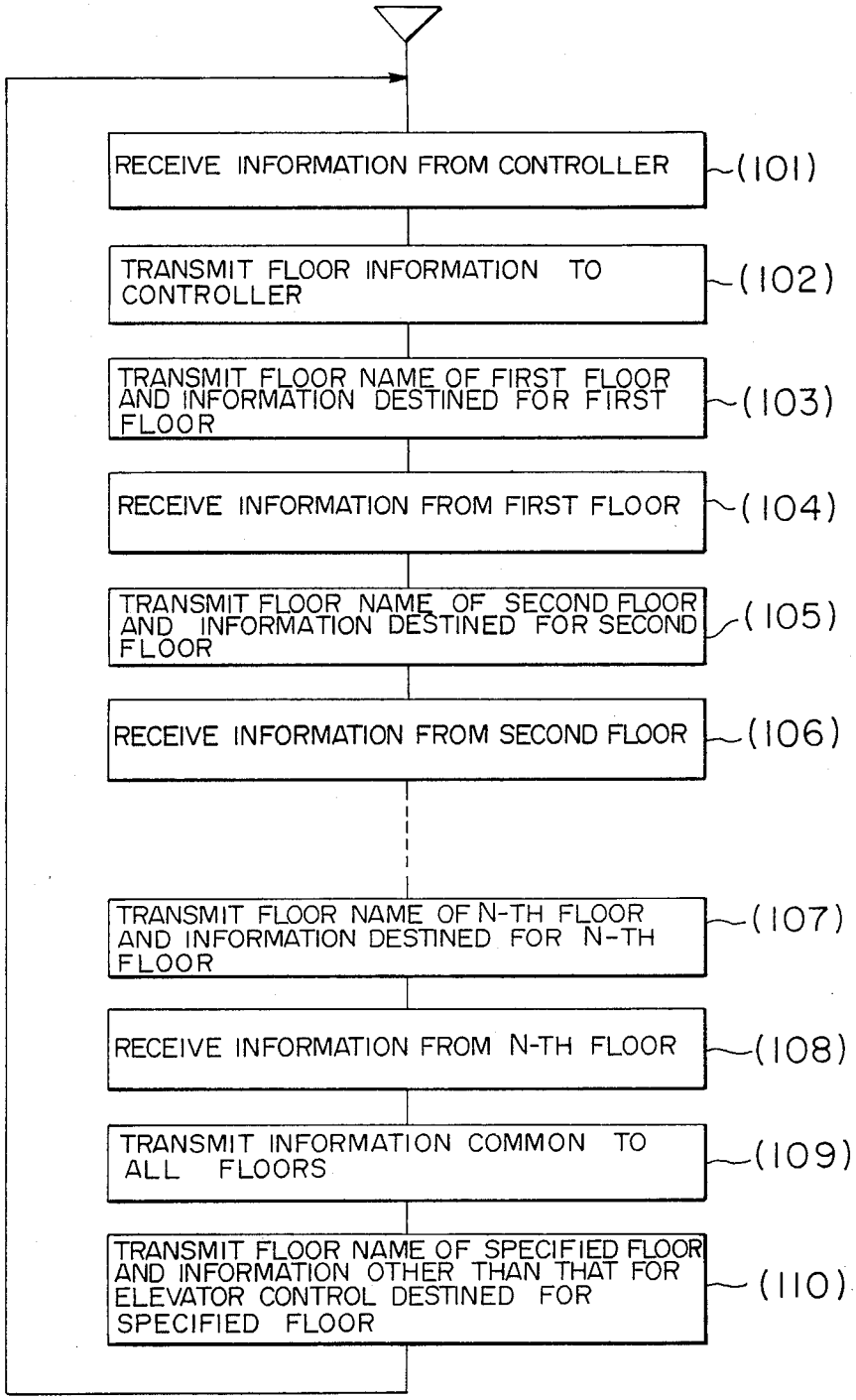
FIG. 6 is a flow chart showing the operation of the transmission host in the FIG. 5 embodiment.

FIG. 6 shows a flow chart of the operation of the transmission host in the FIG. 5 embodiment. As an example, the FIG. 5 embodiment provides sound information services by means of the loudspeakers *7a, 7b, 7c,* ---- *7x* but visual guidance to entertainments being held in the building may be provided using LED displays in place of the loudspeakers *7a, 7b, 7c* ---- *7x*.

Referring to FIG. 6, steps 101 to 109 are the same as those in FIG. 2 and particularly, in step 110, a name of a specified floor to which other information than that necessary for control is desired to be transmitted is transmitted along with that other information and subsequently th operation returns to the step 101. Thus, in accordance with this embodiment, the information other than the elevator control information can be transmitted to a desired floor. The information other than that necessary for elevator control may be inputted to the transmission host from, for example, a personal computer by way of the parallel interface 208 shown in FIG. 3. In such a case, data transmission is effected as will be described hereinafter with reference to still another embodiment of FIG. 8.

Figure 7:
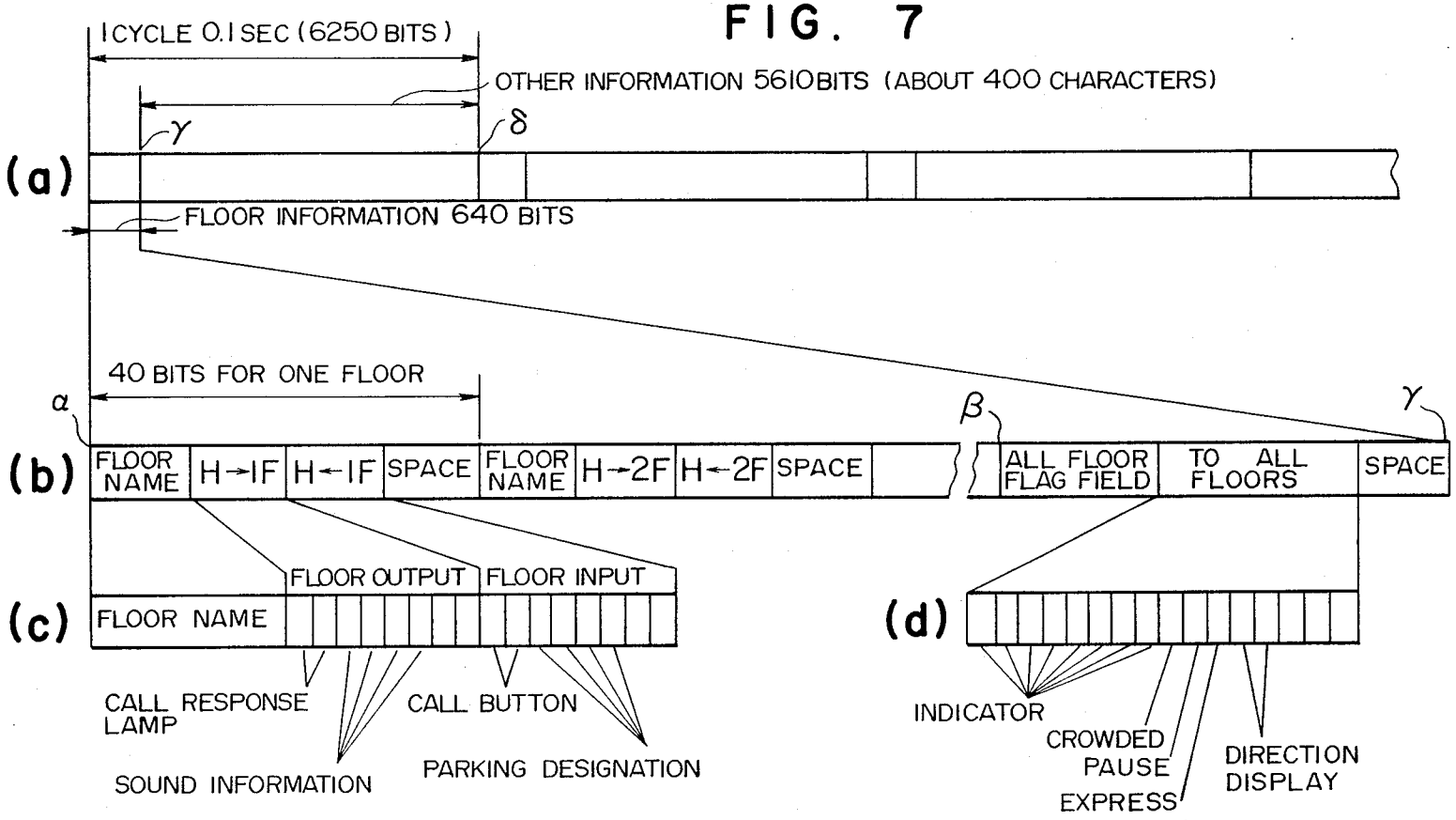
FIGS. 7*a–d* are diagrams showing formats of data to be transmitted in the embodiment shown in FIG. 5.

FIG. 7 illustrates, at sections (*a*) through (*c*), formats of information to be transmitted through the transmission line 6.

In an example shown in FIG. 7, it is assumed that the transmission speed is 62.5 kbps, the number of floors is 15, 8-bit input information and 8-bit output information are used for each floor, and 16-bit information is transmitted from the transmission host 2 to all floors.

As illustrated at section (*a*) in FIG. 7, given that transfer is effected at a rate of one cycle of 0.1 second (6250 bits), 640 bits are allotted to floor information and 5610 bits are allotted to the other information. The floor information shown at (*a*) is broken down as illustrated at (*b*), indicating that 40 bits per floor are provided for 15 floors in all and an all floor flag field and a field of information comoon to all floors are added. The information unique to each floor is broken down as illustrated at (*c*), indicating that a floor name, a floor output field for calling response lamp and the like and a floor input field for call button input and the like are included. The information common to all floors is broken down as illustrated at (*d*), indicating that an indicator (8 bits) and information indicative of "crowded", "pause" or the like are included.

Thus, transmission/reception of information unique to respective floors containing names of respective floors is first carried out and after completion of the transmission/reception of the unique information, a flag indicative of all floors is transmitted so that information can be transmitted to the indicators on all of the floors at a time. It will therefore be appreciated that an interval of time for data transmission shown at sections (*a*) and (*b*) and ranging from $\alpha$ to $\beta$ is a first period for transmission of the unique information, an interval of time for data transmission shown at sections (*a*) and (*b*) and ranging from $\beta$ to $\gamma$ is a second period for transmission of the common information, an interval of time for data transmission shown at section (*a*) and ranging from $\gamma$ to $\delta$ (corresponding to $\alpha$ in the next one cycle) is a third period for transmission of data to a specified floor. In the third period, data may be transmitted to not only a single specified floor but also a plurality of specified floors. In the latter case, like data transmission in the first period ranging from $\alpha$ to $\beta$, address codes of floors for which data is scheduled to be destined are utilized to designate these floors.

In accordance with the present embodiment, the floor information for one cycle separately contains the common information about indicator and the like which is the same for all of the floors and the unique information about hall call button and associated response lamp which is different for the respective floors. Accordingly, even when the transmission speed is relatively low, accurate transmission/reception of the unique information and the information common to all the floors as well as the other information can advantageously be accomplished before one cycle of transmission ends. In the absence of the other information to be transmitted, no data exists on the transmission line 6 during the third period. This is exactly the case with the FIG. 1 embodiment.

Figure 8:
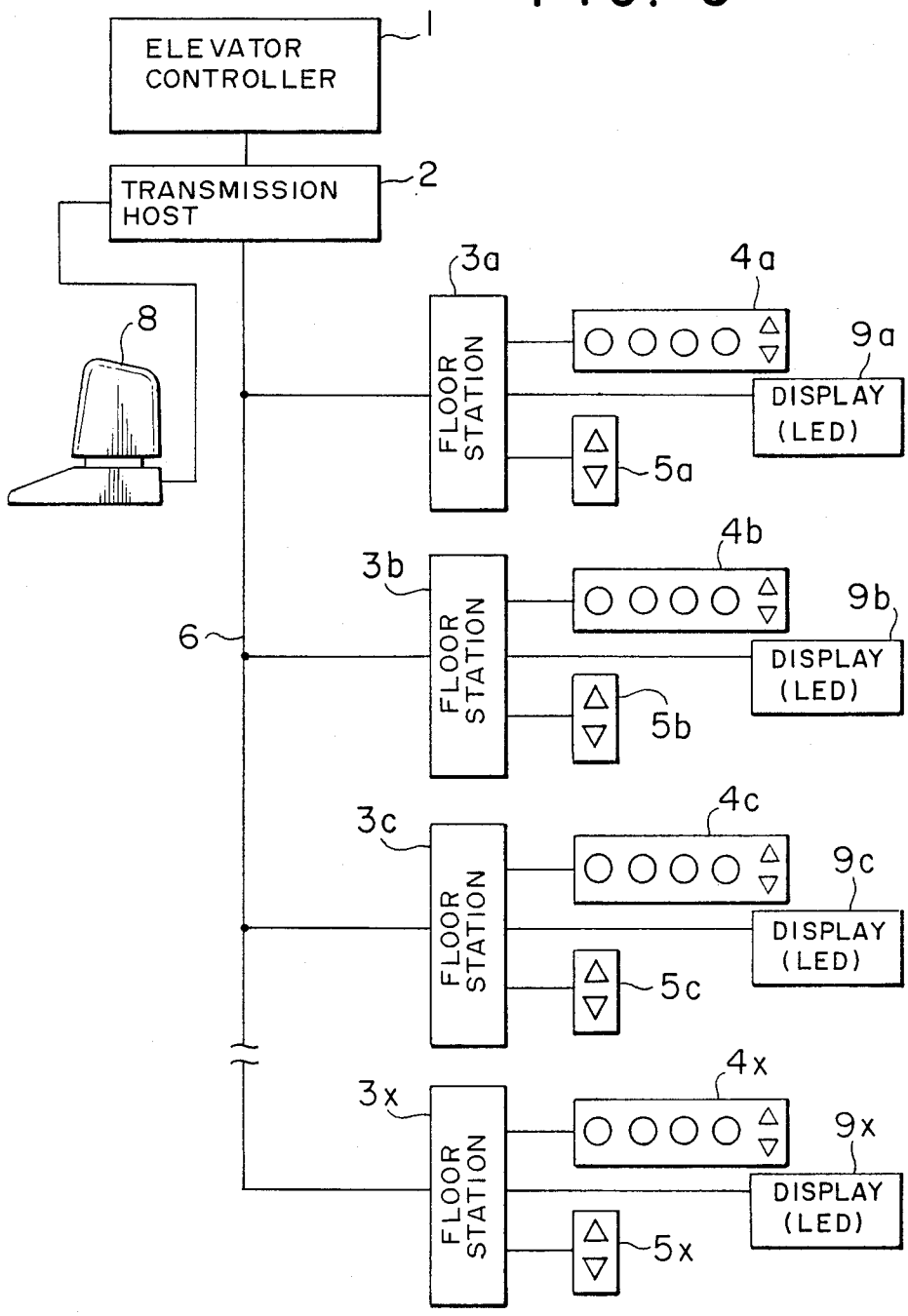
FIG. 8 is a schematic block diagram showing the interconnection of bus mode between the controller and apparatus at elevator stops according to still another embodiment of the invention.

FIG. 8 illustrates still another embodiment wherein other information than that for elevator control is externally inputted from a desired information input device 8. The external desired information input device 8 may readily be constituted by a general-purpose personal computer or a work station, whereby the user can locally engage in transfer of information other than that for elevator control to a desired floor. In this embodiment, the other information than that for elevator control is displayed for information services on LED displays *9a, 9b, 9c,* ---- *9x* by which the information is displayed in the form of a dot image.

Figure 9:
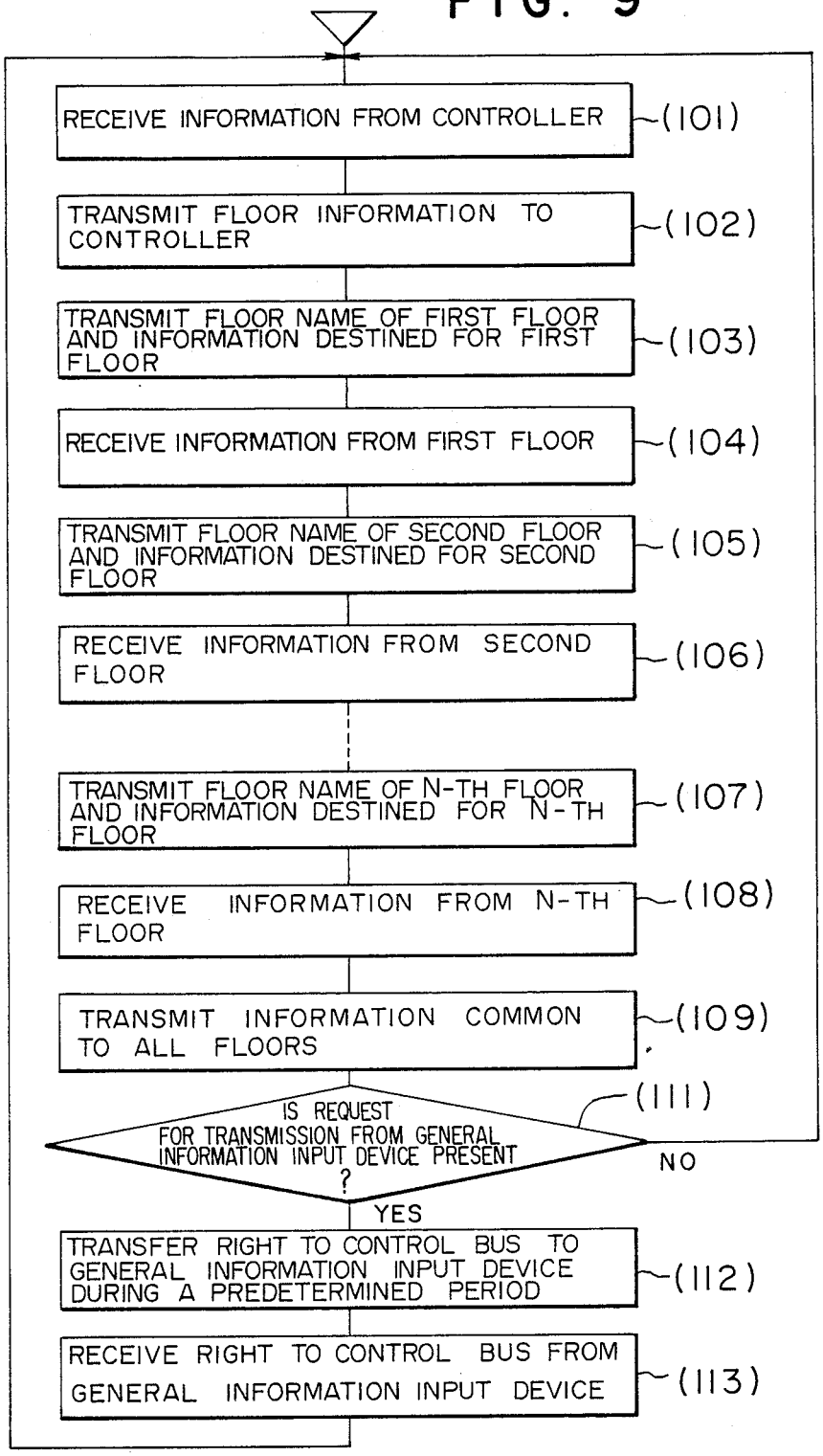
FIG. 9 is a flow chart showing the operation of the transmission host in the FIG. 8 embodiment.

FIG. 9 shows a flow chart of the operation of the transmission host in the FIG. 8 embodiment. Referring to FIG. 9, steps 101 to 109 are identical to those of FIG.

2. Subsequently, the transmission host decides whether the desired information input device 8 requests transmission (step 111). If no, the operation returns to the step 101 but if yes, the right to control the bus is transferred to the desired information input device 8 for a predetermined period of time (step 112). Thereafter, the desired information input d-vice transmits a name of floor for which information is destined and the information, and then returns the right to control the bus to the transmission host (step 113). Subsequently, the operation returns to the step 101. Thus, in accordance with the present embodiment, the information other than that for elevator control can be externally inputted from the desired information input device 8 and can be transmitted to a desired floor.

Figure 10:
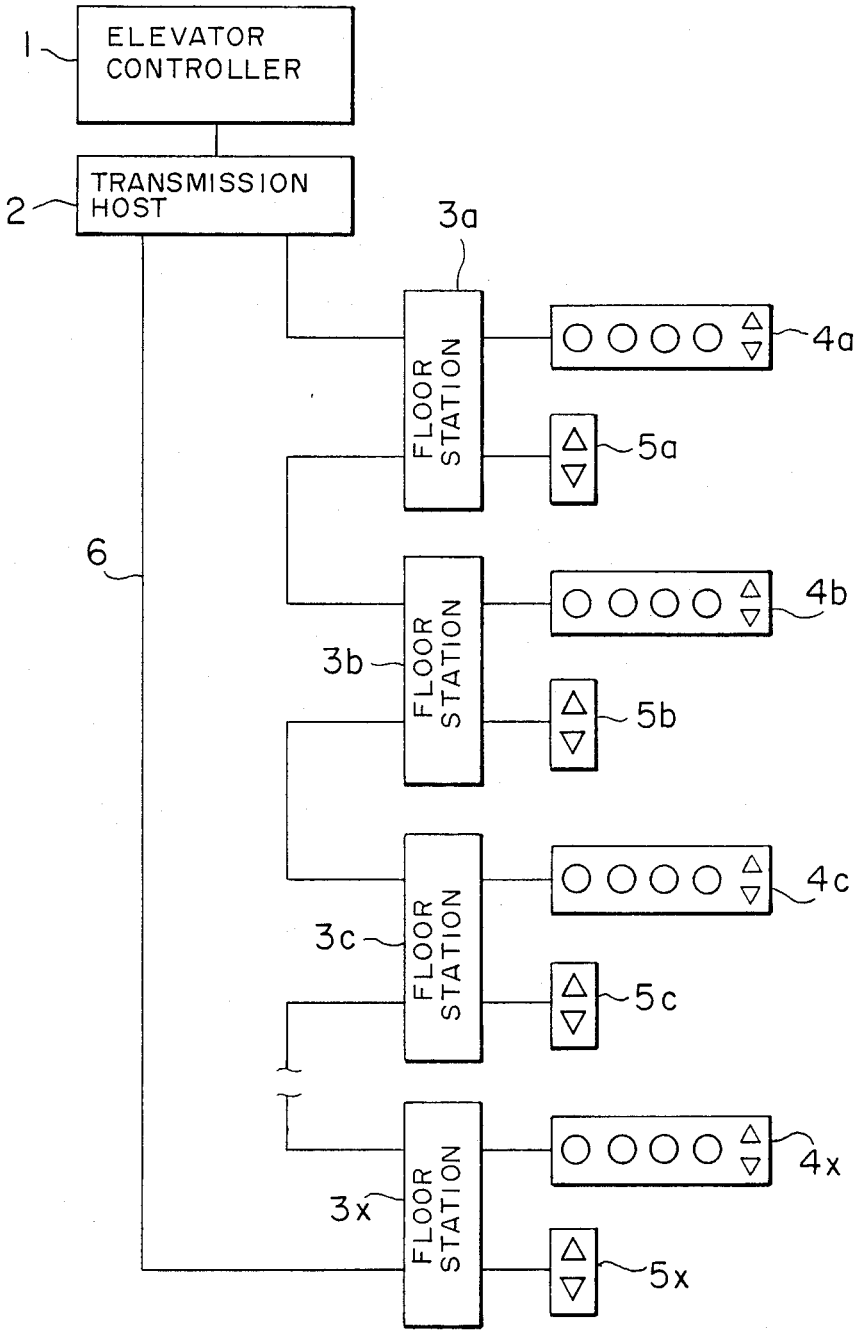
FIGS. 10 and 11 are schematic block diagrams illustrating modifications of the embodiments of FIGS. 1 and 8, respectively.

FIG. 10 illustrates a modification of the FIG. 1 embodiment which is based on loop mode instead of the bus mode. The transmission host 2 is connected in series with floor station 3*a*, 3*b*, 3*c*, ---- 3*x* in succession and the floor station 3*x* connects to the transmission host, thus forming a loop. This embodiment can facilitate the use of optical fibers as the transmission line.

Figure 11:
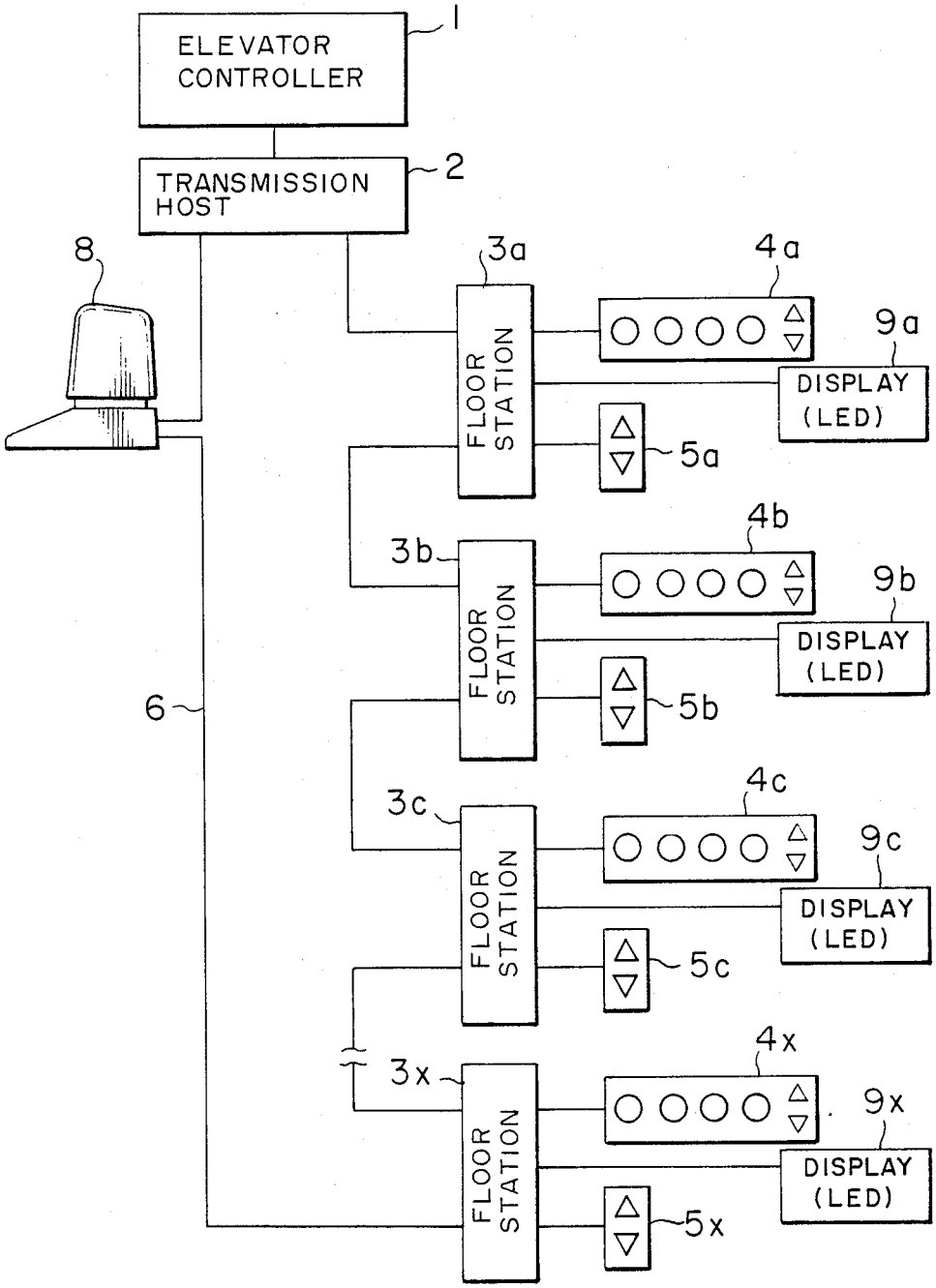

As shown in FIG. 11 the FIG. 10 embodiment of loop mode may be modified wherein the desired information input device 8 is connected as in the embodiment of FIG. 8.

The foregoing embodiments have been described by referring to the transmission of the floor information but if a similar station to that shown in FIG. 4 is provided on the cage, cage information may be transmitted by way of the transmission host. In this case, however, various expedients including increasing the transmission speed and limiting the amount of information are needed because the contents of information handled as the cage information including destination floor call response lamps corresponding to all floors is greater than the contents of the floor information.

Figure 12:
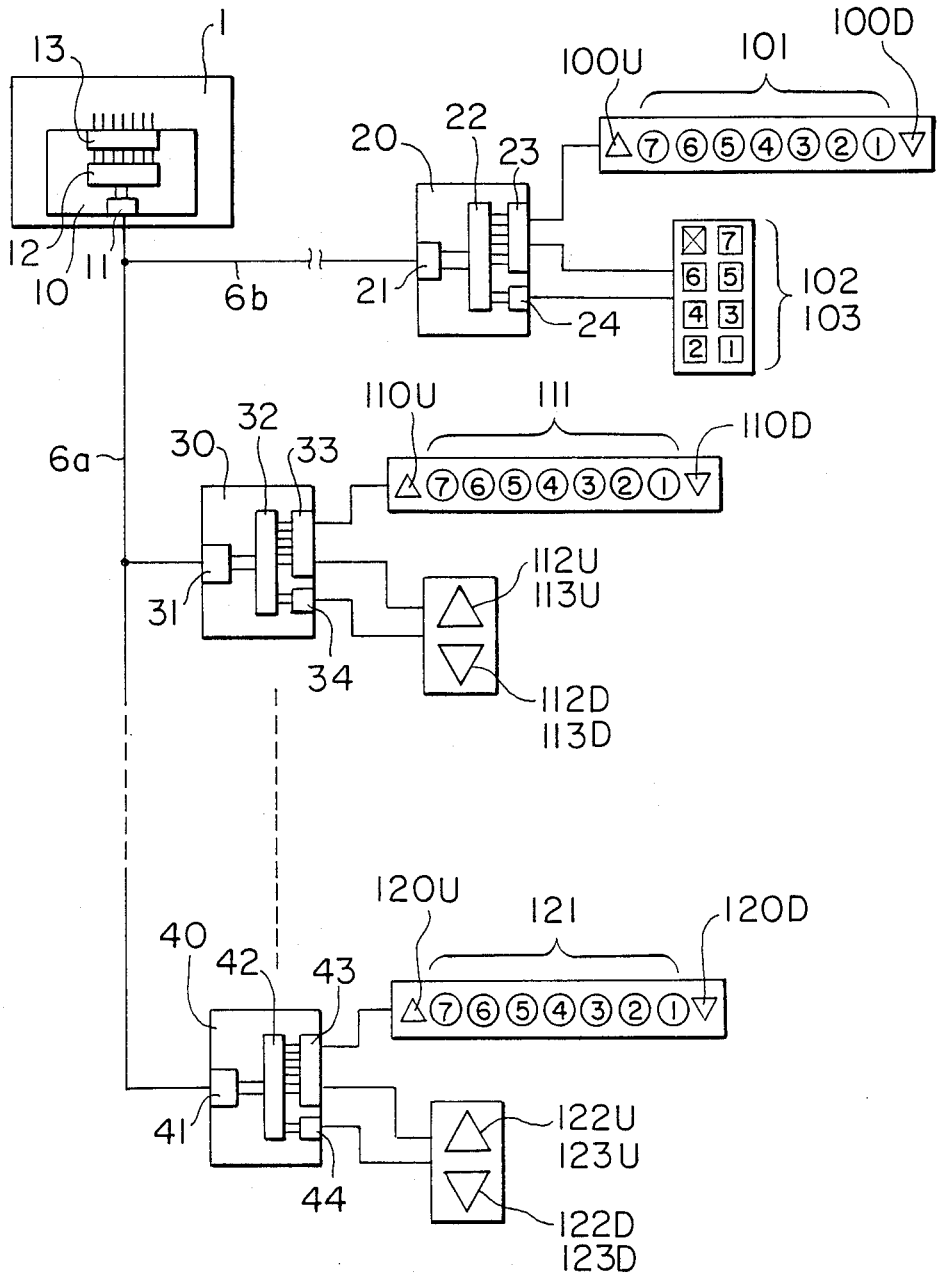
FIG. 12 is a schematic block diagram showing the interconnection of bus mode of the controller with apparatus at elevator stops and a cage according to still another embodiment of the invention.

Then, still another embodiment shown in FIG. 12 has the additional function of detecting inconsistencies in transmitted information. Components in the FIG. 12 embodiment are designated by different reference numerals from those of FIG. 1, excepting an elevator controller generally designated by reference numeral 1.

Referring to FIG. 12, the elevator controller 1 incorporates an information transmitter 10 serving as a master corresponding to the host 2 of FIG. 1, a cage incorporates an information transmitter 20 serving as a slave, information transmitters 30, --- 40 serving as slaves corresponding to the floor stations of FIG. 1 are installed on respective floors, and the above information transmitters are interconnected together by transmission lines 6*a* and 6*b*. The master 10 comprises a microcomputer 12 for processing data, a serial transmission interface 11 and a parallel interface 13 connected to the elevator controller 1. Similarly, the slave 20 comprises a microcomputer 22, a serial transmission interface 21, an output buffer 23 and an input buffer 24, the slave 30 comprises corresponding components 32, 31, 33 and 34, and the slave 40 comprises corresponding components 42, 41, 43 and 44. The output buffer 23 of the slave 20 is connected to direction lamps 100 U and 100 D, cage position indication lamps 101 and a response lamp 102 associated with a call button 103. Similarly, the output buffer 33 of the slave 30 is connected to corresponding elements 110 U and 110 D, 111, and 112 U, 112 D respectively associated with call buttons 113 U and 113 D, and the output buffer 43 of the slave 40 is connected to corresponding elements 120 U and 120 D, 121, and 122 U and 122 D respectively associated with call buttons 123 U and 123 D. On the other hand, the input buffers 24, 34 and 44 of the respective slaves are connected to the call buttons 103, 113 U and 113 D, respectively, and convert on-contact information of call button into a level of +5 V of binary signal and off-contact information into a level of 0 V of binary signal. The binary signal is applied to the microcomputers 22, 32 and 42.

The master 10 collects information from respective slaves through the serial transmission interface 11 to transmit the information to the elevator controller 1 through the parallel interface 13 and also fetches information to be transmitted to the cage and the respective floors from the interface 13 to transmit the information to each slave through the transmission lines 6*a* and 6*b*. In this procedure, data of formats as shown in FIG. 7 may be transmitted but only unique information will be described herein.

On the other hand, the microcomputer of each slave normally performs processings as fetching of call button information and on/off control of the response lamp, direction lamp and cage position indication lamp and in the presence of information transmitted from the master 10, it performs a receiving interruption processing to receive the transmitted information and at the same time transmits information obtained through the normal processings to the master 10.

Figure 13:
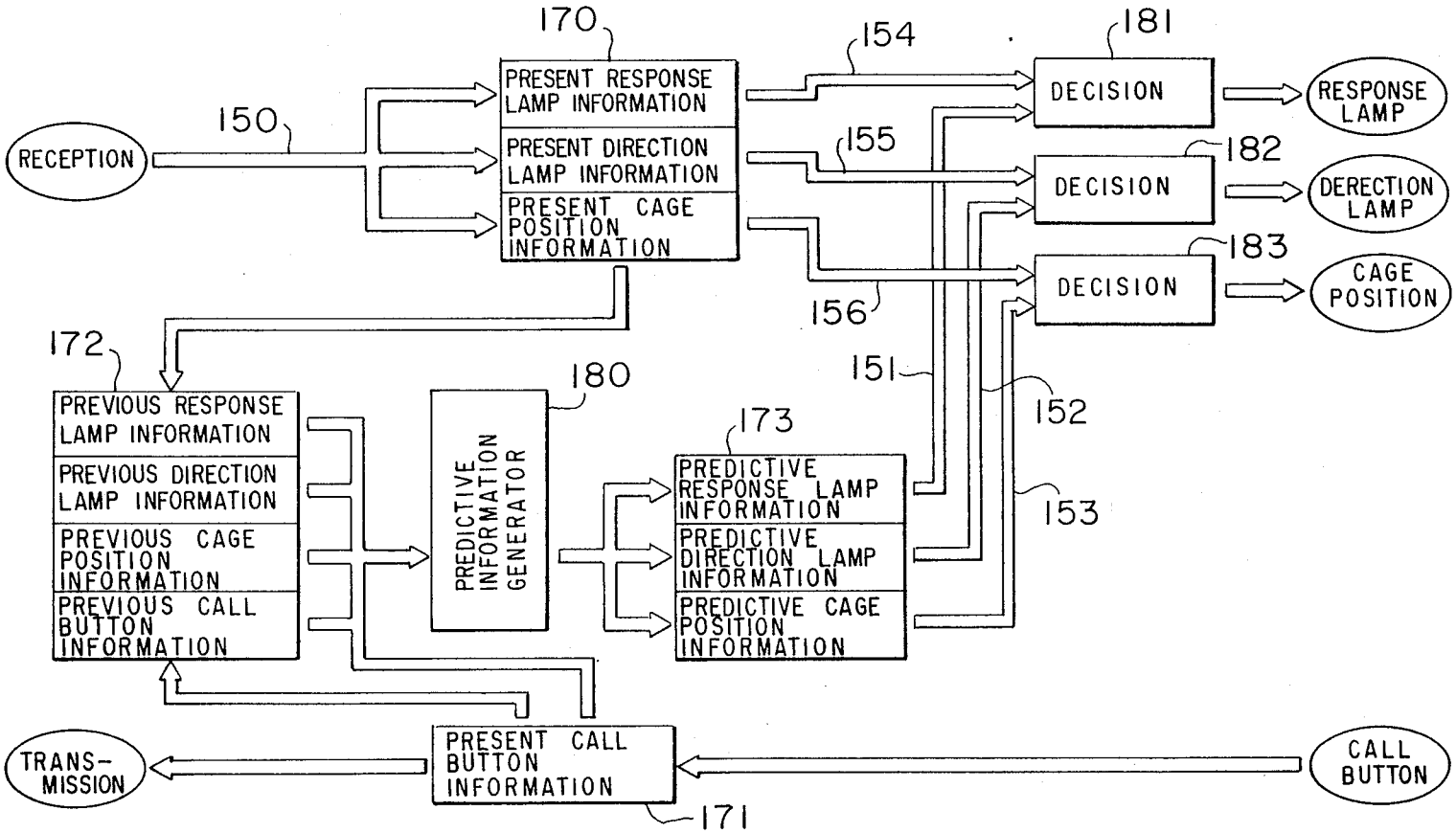
FIG. 13 is a diagram useful in explaining the processing function of a microcomputer of the slave in the FIG. 12 embodiment.

Referring to FIG. 13, the processing function of the microcomputer of each slave will now be described in greater detail.

The microcomputer receives information 150 transmitted from the master to provide present information about the response lamp, direction lamp and cage position and the present information is stored in a memory 170. The microcomputer also fetches a state of call button and the fetched state is stored in a memory 171 and transmitted to the master 10. On the other hand, a predictive information generator 180 calculates, on the basis of previous response lamp information, previous direction lamp information, previous cage position information and previous call button information which are stored in a memory 172 as well as present call button information, predictive response lamp information, predictive direction lamp information and predictive cage position information which may be transmitted subsequently from the master and stores calculation results in a memory 173.

In deciders 181, 182 and 183, predictive information 151 is compared with present information 154, predictive information 152 with present information 155 and predictive information 153 with present information 156, and consistent results produced from the deciders 181 to 183 effect on/off control of the response lamp, direction lamp and cage position indication lamp, respectively.

Finally, the contents of memory 170 and the contents of memory 171 are transferred to the memory 172 and then the above processing repeat itself.

Figure 14:
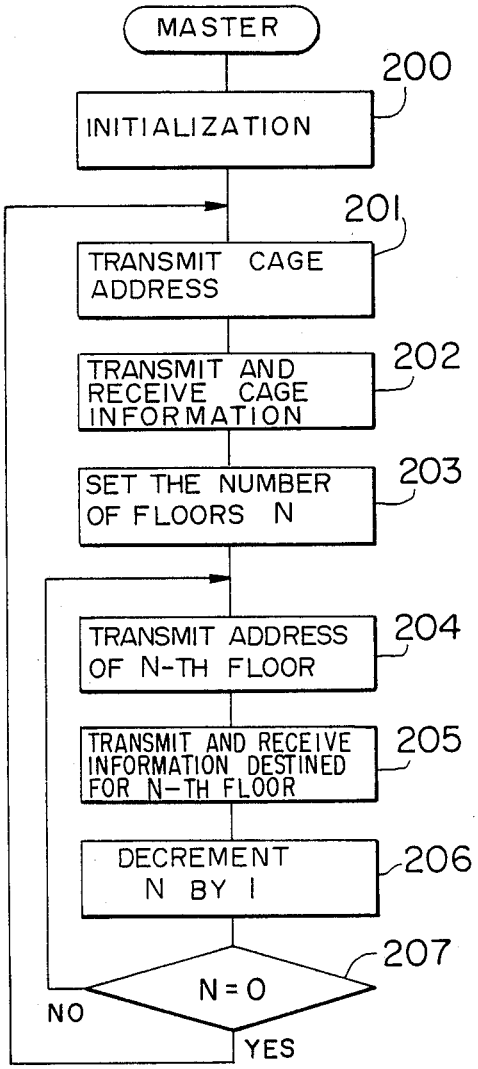
FIGS. 14 and 15 are flow charts respectively showing the processing procedures of the master and slave in the FIG. 12 embodiment.

Referring to FIG. 14, the processing procedure in the master 10 will be described.

Firstly, in step 200, the serial transmission interface 11 and parallel interface 13 are initialized. Subsequently, in step 201, an address of the cage is transmitted to inform that the following information is destined for the cage slave 20 and in step 202, information is transmitted to the cage and information from the cage is received. Thereafter, in steps 203 to 207, transmission/reception of information is effected similarly in respect of the floor slaves the number of which is equal to the number N of floors.

Figure 15:
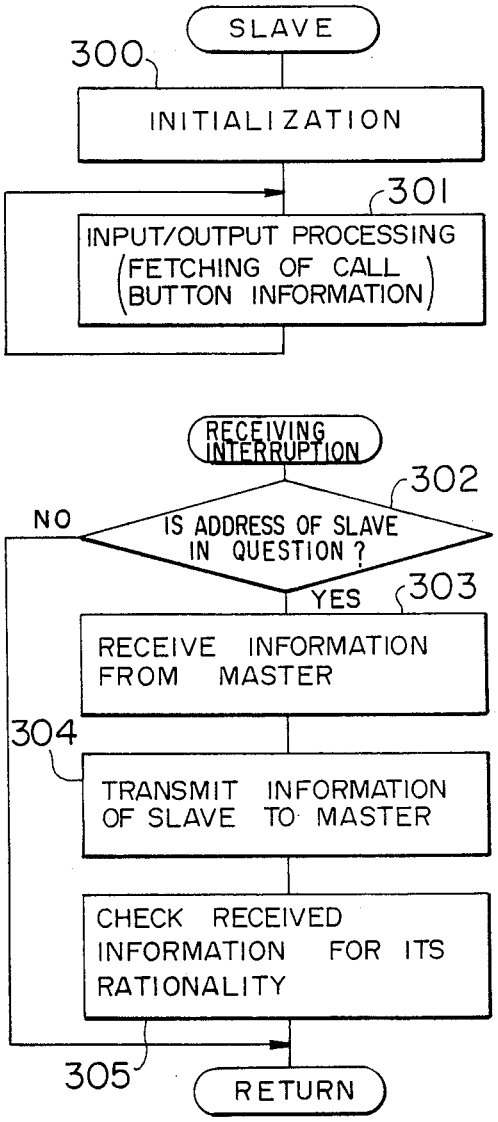

Referring to FIG. 15, the processing procedure in the slave will be described by way of slave 30.

Firstly, in step 300, the serial transmission interface 31 and output buffer 33 are initialized. Subsequently, in step 301, information about the call buttons 113 U and 113 D is fetched and an input/output processing is carried out for turning on or off the direction lamps 110 U and 110 D, cage position indication lamp 111, and response lamps 112 U and 112 D. Normally, the input/output processing repeats itself. Thereafter, when a slave address is transmitted from the master, the slave 30 generates receiving interruption and performs an interruption processing. In the interruption processing, the slave address is first decided in step 302 and if non-coincident, the operation is by-passed to the normal processing. If coincident, information from the master 10 is received in step 303 and floor information (indicative of a state of the call button) is transmitted to the master 10 in step 304. In the subsequent step 305, the received information is checked for its rationality and if consistent, the received information is fetched as normal information.

Figure 16:
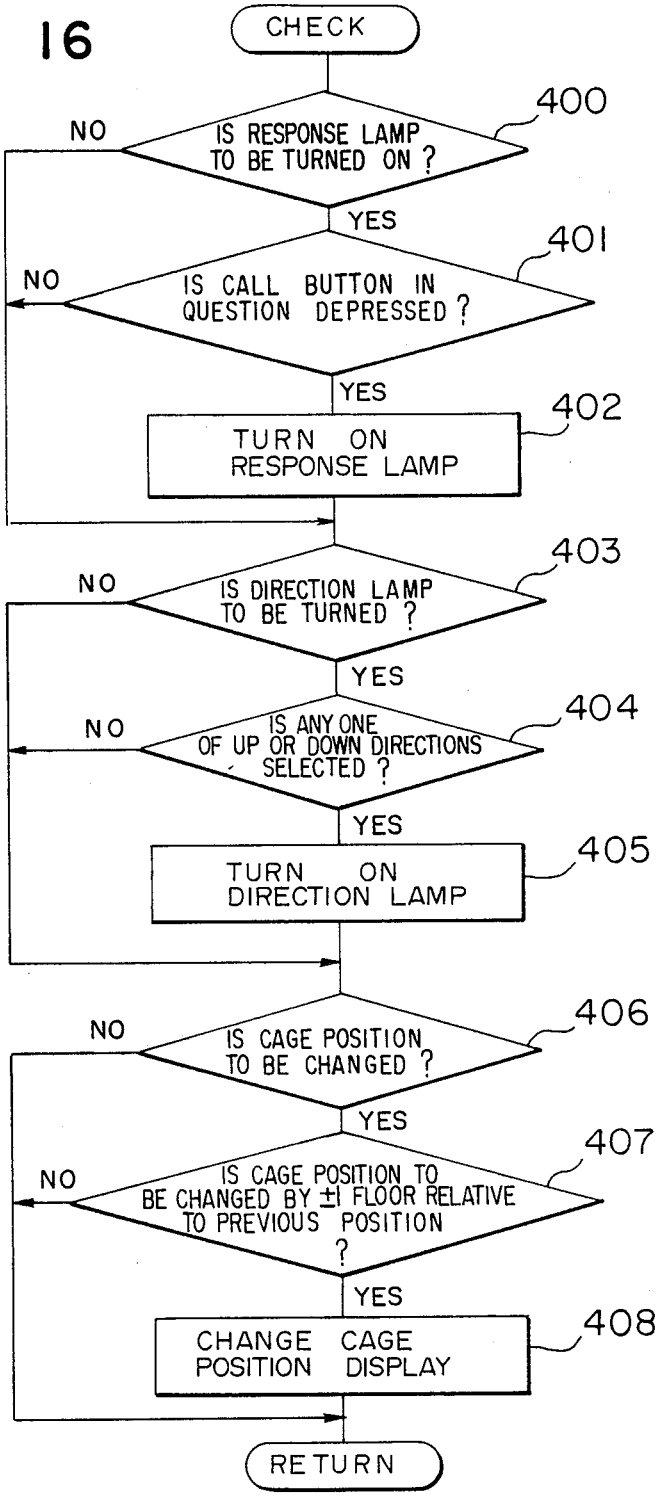
FIG. 16 is a flow chart showing the processing procedure for checking rationality of the slave in the FIG. 12 embodiment.

Referring to FIG. 16, an example of processing procedure for checking rationality will be described. Firstly, in order to check the response lamp for its rationality, it is decided in step 400 whether the response lamp is to be turned on. If no, the procedure proceeds to the next check item. If yes, whether the call button associated with the response lamp to be turned on has been depressed or is being depressed is collated, in step 401, with the information obtained through the input/output processing in FIG. 15. If depressed, the response lamp is turned on in step 402. If not depressed, the received information is decided to be erroneous information and the procedure is by-passed. Next, in order to check the direction lamp for its rationality, it is decided in step 403 whether the direction lamp is to be turned on. If yes, it is decided in step 404 whether any one of the up-direction lamp and down-direction lamp is to be turned on. If the answer is yes or simultaneous turn-on of both the direction lamps is negated, the direction lamp is turned on in step 405. Finally, in order to check the cage position indication lamp for its rationality, it is decided in step 406 whether the cage position indication is to be changed. If yes, it is decided in step 407 whether the cage position is to be changed by $\pm 1$ floor (one floor up or down) relative to the previous position. If the answer is yes or the change falls within $\pm 1$ floor, display of the cage position indication lamp is changed in step 408.

Figure 17:
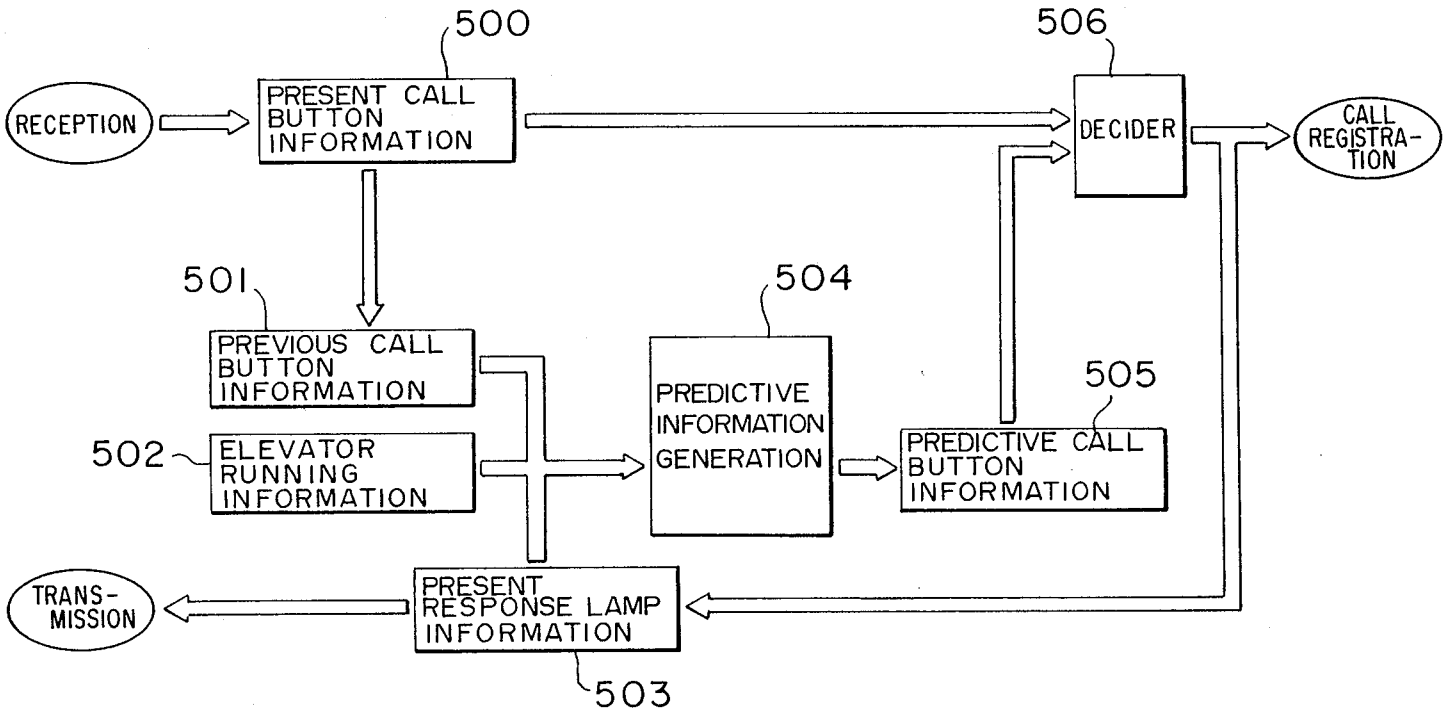
FIG. 17 is a diagram useful in explaining the processing function of a microcomputer of the master in the FIG. 12 embodiment.

The rationality checking procedure has been described in connection with the slaves installed on the respective floors but it may be applied similarly to the cage slave, though having a different number of call buttons and associated response lamps. The master can check the information from the elevator controller for its rationality in a similar manner. This will be described with reference to FIG. 17.

When the master receives present call button information 500 from the floor slave or the cage slave, a decider 506 compares predictive call button information 505, which is generated by a predictive information generator 504 on the basis of previous call button information 501, previous elevator running information and present response lamp information 503, with the present call button information 500 to check it for its rationality. A consistent result produced from the decider 506 is subjected to call registration and at the same time transmitted, as response lamp information 503, to the slave in question. The elevator running information 500 referred to herein is sequentially generated by the microcomputer of the master and includes cage position information, parking information and door open/close information.

For example, the call button on the n-th floor is presently turn on and has previously been turn on. However, the n-th floor is n parking floor and it is expected that the predictive information generator 504 determines that the call button on the n-th floor is to be normally turned off. Consequently, the decider 506 determines the calling from the n-th floor not to be subjected to registration, thus preventing the response lamp from being turned on. At the same time, a fault decision to the effect that the call button on the n-th floor is presumably faulty is issued.

Since, in accordance with the present invention, inconsistencies in information received through normal procedure by way of the transmission lines 6*a* and 6*b* can be detected, reliability of the information can further be improved.

In this embodiment, the bus mode transmission is exemplarily used for connection but obviously the present invention may be applied to a system in which the connection is based on a ring mode transmission line.

Figure 18:
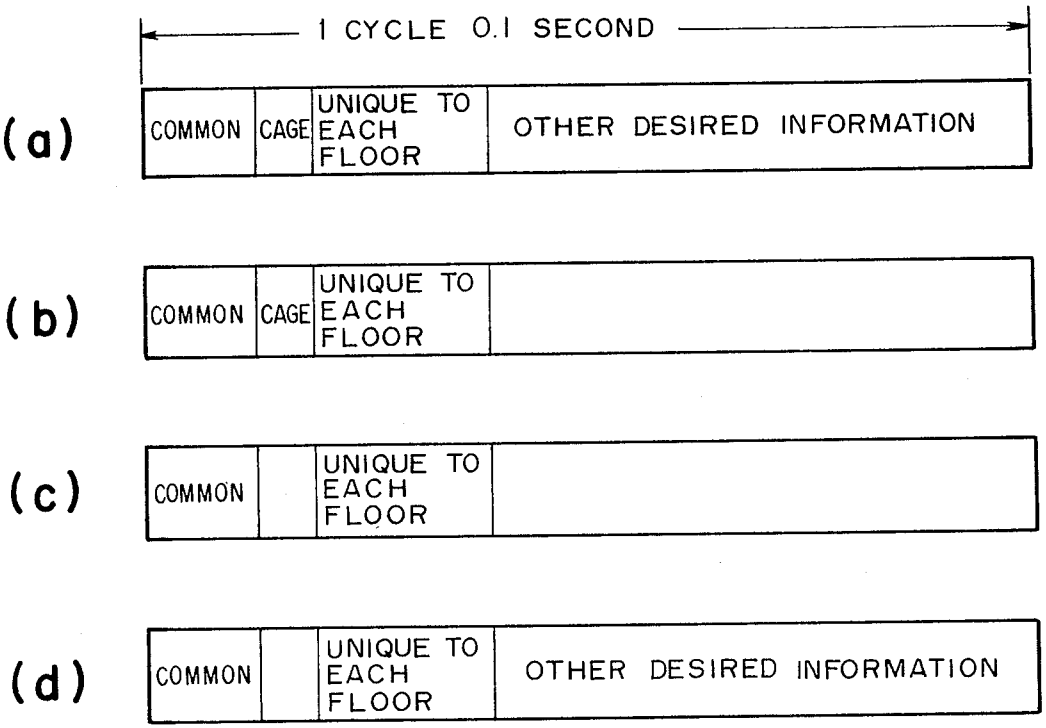
FIGS. 18*a–d* are diagrams showing modified formats of data to be transmitted during one cycle.

FIG. 18 schematically illustrates modifications of formats of data information transmitted during one cycle (duration of 0.1 second). Different from the example of FIG. 7, the example of FIG. 18 is so formatted as to transmit common information earlier than unique information. Exemplified at sections (*a*) and (*b*) are formats of information which can be transmitted to not only the floor slave but also the cage slave and exemplified at sections (*c*) and (*d*) are formats of information which can be transmitted to only the floor slave. In the formats shown at (*a*) and (*b*), desired information other than that for elevator control is added and in the formats shown at (*b*) and (*c*), desired information other than that for elevator control is not added.

The data is sequenced in accordance with programs written in ROM's of the master and the slave. Accordingly, the data sequence can be set desirably by changing the programs.

We claim:

1. A signal transmission method in elevator equipment wherein an elevator controller is connected to a plurality of apparatus installed at elevator stops on respective floors through a main station, remote stations and a common transmission line, and serial transmission of signal is effected between said controller and the respective apparatus at elevator stops on respective floors, said method comprising:

effecting transmission/reception of a signal unique to each of said plurality of apparatus on respective floors during a first period; and effecting transmission/reception of a signal common to said plurality of apparatus on respective floors during a second period.

2. A signal transmission method in elevator equipment according to claim 1 further comprising effecting transmission/reception of a desired signal between a specified, desired apparatus at elevator stop and said elevator controller during a third period.

3. A signal transmission method in elevator equipment according to claim 1 wherein an apparatus of a cage is connected to said common transmission line through a remote station, and transmission/reception of a signal unique to said cage is effected during the first period and transmission/reception of a signal common to said cage and said plurality of apparatus on respective floors is effected during the second period.

4. A signal transmission method in elevator equipment according to claim 3 further comprising effecting transmission/reception of a desired signal between a specified one of said elevator controller and said cage apparatus as well as said plurality of apparatus at elevator stops on respective floors during a third period.

5. A signal transmission method in elevator equipment according to claim 3 wherein said second period is followed by said first period, and during said first period, transmission/reception of a signal is effected between said cage apparatus and said elevator controller and thereafter transmission/reception of a signal unique to each apparatus on each floor if effected between each apparatus at elevator stop on each floor and said elevator controller.

6. A signal transmission method in elevator equipment according to claim 4 wherein said second period is followed by said first period, and said first period is followed by said third period, and wherein during said first period, transmission/reception of a signal is effected between said cage apparatus and said elevator controller and thereafter transmission/reception of a signal unique to each apparatus on each floor is effected between each apparatus at elevator stop on each floor and said elevator controller.

7. A signal transmission method in elevator equipment according to claims 1 or 2 wherein in at least one of said elevator controller and each of said plurality of apparatus installed at elevator stops on respective floors, predictive information is generated from previous information, and the predictive information is compared with information received through said transmission line to check the received information for its rationality.

8. A signal transmission method in elevator equipment according to any one of claims 3 to 6 wherein in at least one of said elevator controller and each of said plurality of apparatus installed at elevator stops on respective floors as well as said cage apparatus, predictive information is generated from previous information, and the predictive information is compared with information received through said transmission line to check the received information for its rationality.

9. A signal transmission method in elevator equipment according to any one of claims 1 to 6 wherein said transmission line is based on either bus mode o loop mode.

10. A signal transmission method in elevator equipment according to claim 7 wherein said transmission line is based on either bus mode or loop mode.

11. A signal transmission method in elevator equipment according to claim 8 wherein said transmission line is based on either bus mode or loop mode.

12. A signal transmission method in elevator equipment according to any one of claims 1 to 6 wherein said signal unique to each of said plurality of apparatus on respective floors corresponds to signals representative of call buttons and associated response lamps on respective floors and said signal common to said plurality of apparatus on respective floors corresponds to signals representative of indicators for display of elevator cage position and of running direction.

13. A signal transmission method in elevator equipment according to claim 7 wherein said signal unique to each of said plurality of apparatus on respective floors corresponds to signals representative of call buttons and associated response lamps on respective floors and said signal common to said plurality of apparatus on respective floors corresponds to signals representative of indicators for display of elevator cage position and of running direction.

14. A signal transmission method in elevator equipment according to claim 8 wherein said signal unique to each of said plurality of apparatus on respective floors corresponds to signals representative of call buttons and associated response lamps on respective floors and said signal common to said plurality of apparatus on respective floors corresponds to signals representative of indicators for display of elevator cage position and of running direction.

15. A signal transmission system in elevator equipment comprising an elevator controller, a plurality of apparatus installed at elevator stops on respective floors, a main station for receiving signals from said plurality of apparatus at elevator stops, a plurality of remote stations, installed on respective floors, for receiving a signal from said controller and transmitting signals produced from said plurality of apparatus at elevator stops, and a common transmission line for interconnecting said main station and said plurality of remote stations, said main station having means for transmitting a first identification signal indicative of a floor name of any one of said plurality of apparatus on respective floors and a second identification signal representative of a floor name common to said plurality of apparatus on respective floors, each of said plurality of remote stations having means for collating, when receiving the first identification signal from said main station, the received first identification signal with a floor name of its own and effecting, if coincidence occurs, transmission/reception of a signal unique to own remote station and for normally receiving, when receiving the second identification signal, a signal common to said plurality of apparatus on respective floors.

16. An information transmission system in elevator equipment comprising a first information transmitter (main station) installed as a master in an elevator controller provided in a machine room of a building, second information transmitters (remote stations) respectively installed as slaves on respective floors of the building and carried on a cage, and a transmission line for interconnecting said first information transmitter and second information transmitters whereby said first information transmitter sequentially designates said second information transmitters to effect transmission/-reception of information, at least one of said first and second information transmitters including means for generating predictive information from previous information, and means for comparing the predictive information with information received through said transmission line to check the received information for its rationality.

17. A signal transmission system in elevator equipment according to claim 16 wherein said second information transmitter includes means for detecting that an up-direction elevator call button or a down-direction elevator call button installed on respective floors is depressed and means for turning on response lamps associated with said up-direction and down-direction call buttons, and said predictive information is such information that indicates that when information from said first information transmitter is for instructing the response lamp to be turned on, the associated call button has been depressed.

18. A signal transmission system in elevator equipment according to claims 16 or 17 wherein said second information transmitter includes means for turning on a direction lamp indicative of running direction of the elevator cage, and said predictive information is such information that indicates that when information from said first information transmitter is for instructing the direction lamp to be turned on, the up-direction and down-direction lamps are not to be turned on simultaneously.

19. A signal transmission system in elevator equipment according to claims 16 or 17 wherein said second information transmitter includes means for displaying the elevator cage position, and said predictive information is such information that indicates that when information from said first information transmitter is for instructing the elevator cage position display to be changed, the cage position is to be changed by $\pm 1$ floor (one floor up or down) relative to the previous position.

20. A signal transmission system in elevator equipment according to claim 18 wherein said second information transmitter includes means for displaying the elevator cage position, and said predictive information is such information that indicates that when information from said first information transmitter is for instructing the elevator cage position display to be changed, the cage position is to be changed by $\pm 1$ floor (one floor up or down) relative to the previous position.

* * * * *